US005273376A

United States Patent [19]

Ritter, Jr.

[11] Patent Number: 5,273,376

[45] Date of Patent: Dec. 28, 1993

[54] BACK-UP CONNECTOR RELEASE TOOL

[75] Inventor: Paul B. Ritter, Jr., Slidell, La.

[73] Assignee: Shell Offshore Inc., Houston, Tex.

[21] Appl. No.: 833,279

[22] Filed: Feb. 10, 1992

[51] Int. Cl.[5] ..... F16L 1/12

[52] U.S. Cl. ..... 405/169; 405/191; 405/223.1

[58] Field of Search ..... 405/169, 158, 190, 191, 405/204, 223.1, 224.1; 166/339, 340, 348, 349

[56] References Cited

U.S. PATENT DOCUMENTS 3,166,123 1/1965 Watkins .
3,463,226 8/1969 Johnson .
3,504,740 4/1970 Manning .
3,766,742 10/1973 Smith et al. .
4,086,776 5/1978 Beard .
4,109,601 8/1978 Ronnevig .
4,557,628 12/1985 Cowan .
4,702,320 10/1987 Gano et al. .
4,721,055 1/1988 Pado .
4,878,694 11/1989 Castel ..... 405/169 X
4,906,136 3/1990 Norbom et al. ..... 405/169
5,046,895 9/1991 Baugh ..... 405/191 X
5,069,580 12/1991 Herwig et al. ..... 405/191
5,074,717 12/1991 Hope et al. ..... 405/169 X

*Primary Examiner*—Dennis L. Taylor
*Assistant Examiner*—J. Russell McBee

[57] ABSTRACT

An emergency release tool for operation by a remotely operated vehicle (ROV) for forcefully releasing a riser from a subsea well assembly The tool includes hydraulic cylinders mounted on a frame that can be positioned by the remotely operated vehicle to surround the risers. The cylinders are pressurized to forcefully remove the riser from the wellhead assembly.

8 Claims, 2 Drawing Sheets

BACK-UP CONNECTOR RELEASE TOOL

BACKGROUND OF THE INVENTION

The present invention relates to the drilling and production from offshore wells and particularly wells in water depths beyond those where conventional divers may operate. As the search for petroleum deposits in offshore waters continues, it has moved into deeper and deeper waters, beyond the depths at which divers can operate. The depths have increased to the point where the use of conventional bottom-supported production platforms is no longer practical. This has led to the use of floating production platforms which require the use of remotely operated subsea wellhead assemblies. The remotely operated equipment includes the installation of various wellhead assemblies during drilling and production such as conventional blowout preventer assemblies as well as lower marine riser assemblies. In addition, after the drilling is completed, other assemblies must be remotely attached to the wellhead, for example, marine risers and production flow lines. All of these assemblies require that they be remotely connected and removed from the subsea well.

The conventional approach to the attachment and removal of various subsea assemblies has relied upon the remote actuation of various latching means. For example, conventional dog-like members have been moved into and out of engagement with the permanently installed subsea well assembly by either mechanical or hydraulic means. For example, hydraulic fluid could be utilized to move a cam which would move the latching members into a latched position or, alternatively, into an unlatched position. Removal of the hydraulic pressure would allow a spring means to move the latches into an unlatched position or, alternatively, into a latched position. Similarly, weight on the tubing string used for running the assembly to the subsea wellhead could be either removed or applied to operate the latching mechanism.

While the various remotely operated latching means have a high degree of reliability, there is always the possibility that the latching mechanism will fail to operate or will become stuck in a latched position. In these circumstances, it would be impossible to remove the subsea assembly. These conditions will normally occur after the assembly has been in place for an extended period of time. Typically, only the production equipment is subject to these conditions since the drilling equipment is normally in place only a short period of time during the actual drilling of the well. Whenever the latching means fails to operate for any reason, some means must be provided for an emergency release of the subsea assembly to allow other operations to be performed.

In U.S. Pat. No. 4,086,776, there is disclosed a release means for releasing a cam-operated locking means used to lock the end of a guide line assembly to a subsea well assembly. The means shown comprise a "scissors" arrangement which is opened to force the locking means into an unlocked position. The scissors arrangement is shown as hydraulically operated by a submersible vessel.

The system disclosed in the '776 patent requires only a modest effort to move the locking means to an unlocked position and does not forcefully remove the guide line assembly from the subsea wellhead assembly. Even if the locking means is moved to an unlocked position, it is still possible that the locking dogs will remain in place and make it impossible to remove the guide line assembly from the subsea assembly.

SUMMARY OF THE INVENTION

The present invention solves the above problems by providing a remotely operated release tool which operates mechanically to forcefully release an assembly from the subsea wellhead assembly. The release tool has sufficient mechanical power to overcome the locking means and forcefully separate the assembly from the subsea equipment.

The release tool utilizes a frame member which can be inserted between two flanges on the members that are to be separated. The frame member includes an hydraulic means which can be powered from a remotely operated vehicle (ROV). In place of an ROV, an umbilical hydraulic line extending from the surface could be used to power the system. The hydraulic means is designed to provide sufficient mechanical force so that it can physically separate the member from the subsea equipment even in those instances where the locking means remains engaged.

While the emergency release tool is capable of generating sufficient mechanical force to overcome the locking means, it is still relatively light and compact and therefore, is easily handled by the ROV. This is accomplished by providing a relatively light frame for holding the hydraulic means and then positioning the hydraulic means between the two flanges of the embers that are to be separated. The only portion of the release means that must be capable of structurally resisting the forces required for separating the members are the hydraulic means while all the remaining structure is mere support means. This is important when the devices are to be transported and maneuvered by remotely operated vehicles since most ROV's have a limited lift capacity.

While it is preferred that the release tool be designed so that it may be handled by an ROV, other configurations are also possible. For example, the release tool could be incorporated as a component of the wellhead assembly and designed so that it can be replaced if it fails to operate. An additional variation would be a provision for releasing the ROV from the release tool after it is positioned on the wellhead.

DESCRIPTION OF PREFERRED EMBODIMENTS

Figure 1:
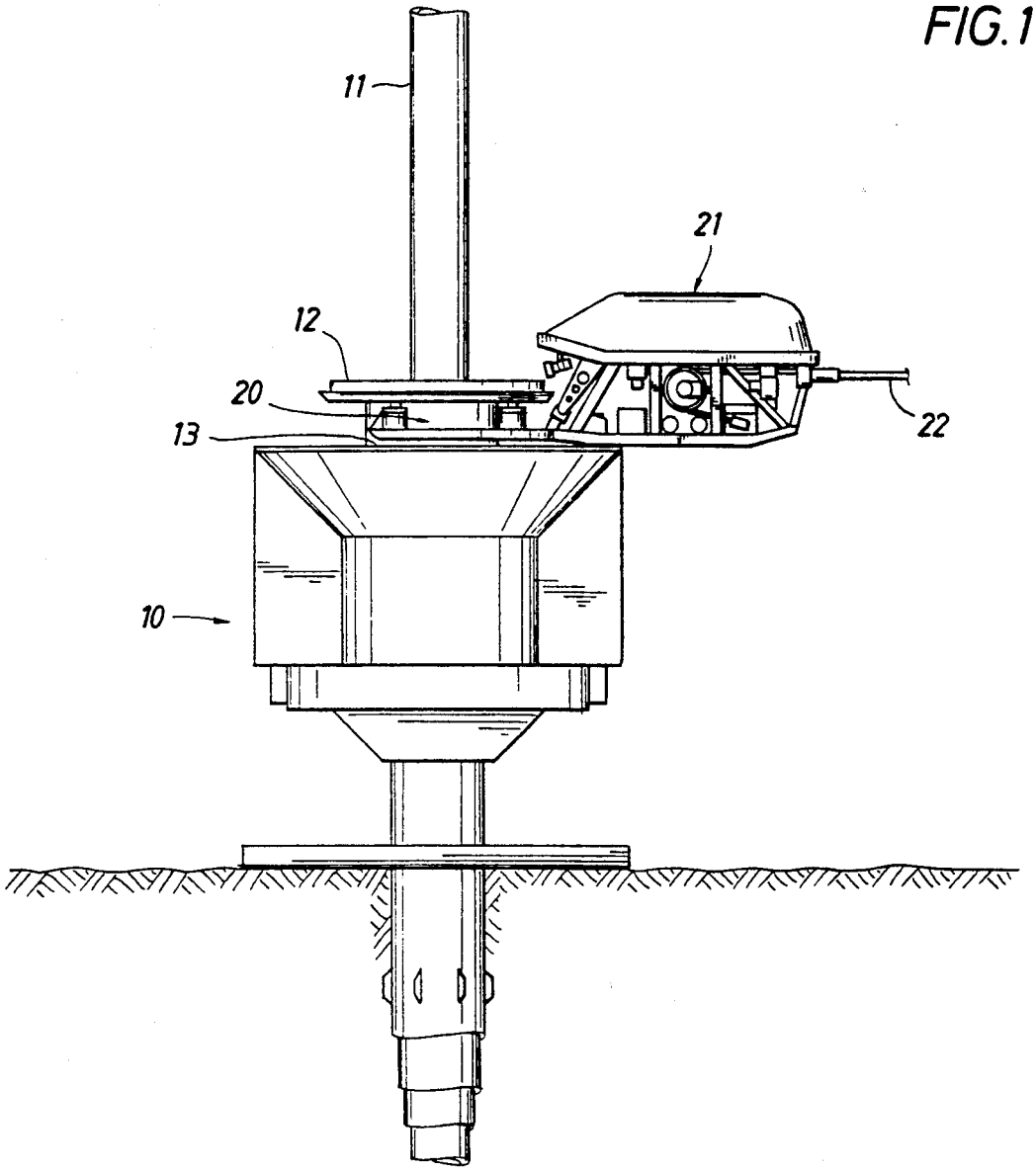
FIG. 1 is an elevation view of the emergency release mechanism positioned on the subsea wellhead assembly.
Figure 2:
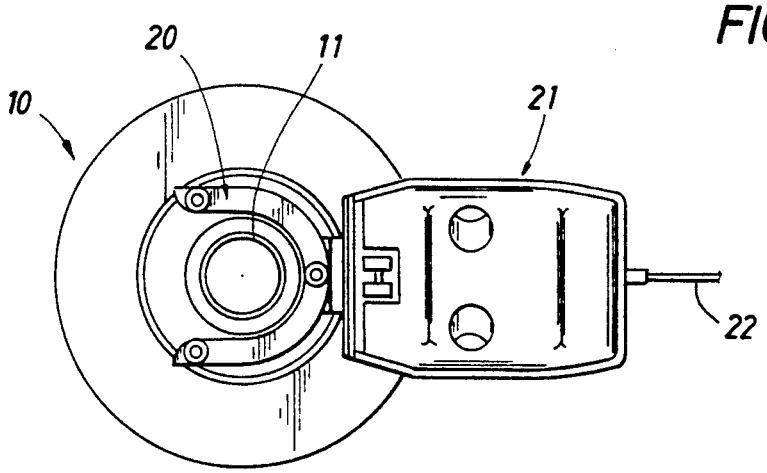
FIG. 2 is a top view of the assembly shown in FIG. 1 with a portion removed for clarity.

Referring to FIGS. 1 and 2, there is shown a subsea well assembly 10 installed on the ocean floor. The well assembly includes a mud mat, marine wellhead, and several casing strings that are suspended from the wellhead. The casing terminates in a wellhead assembly that includes a funnel-shaped guide means and suitable surfaces so that equipment such as blowout preventers and lower marine riser assemblies can be attached to the casing during drilling operations. Also, production equipment such as the production riser 11 can be secured to the wellhead assembly during production operations. The production riser 11 is provided with a flange 12 at its lower end adjacent the top of the subsea well assembly. The flange 12 is securely fastened to the riser and provided with sufficient structural strength to resist bending when the emergency release tool is utilized to remove the riser from the subsea assembly. A similar flange 13 is secured to the top of the funnel-shaped guide means. In the alternative, the funnel-shaped guide means in itself may be used as the cooperating flange under certain conditions.

Shown positioned between the opposed flanges 12 and 13 is the emergency release tool 20. Release tool 20 is transported and positioned by means of a remotely operated vehicle (ROV) 21. The remotely operated vehicle is connected to the surface by a suitable umbilical cord 22 that contains both the conductors for sending control signals to the ROV as well as cables for supplying power to the ROV in those cases where the ROV is not self-contained. Various offshore oilfield service companies offer ROVs that are capable of lifting weights of 100 to 500 pounds and supplying hydraulic power to operate various wellhead equipment. These vehicles are all provided with freedom of motion to accurately position themselves or the equipment on the wellhead.

Figure 3:
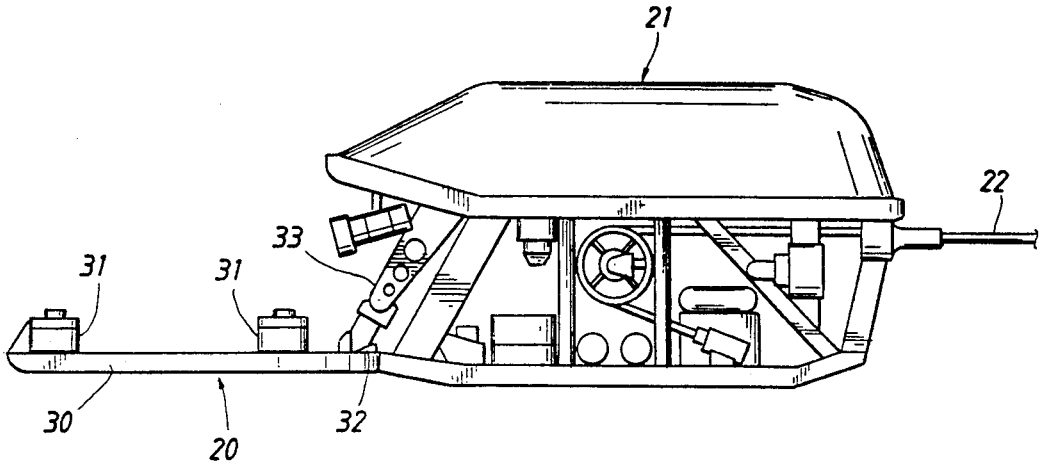
FIG. 3 is an enlarged view of the remotely operated vehicle with the emergency release tool secured thereto.
Figure 4:
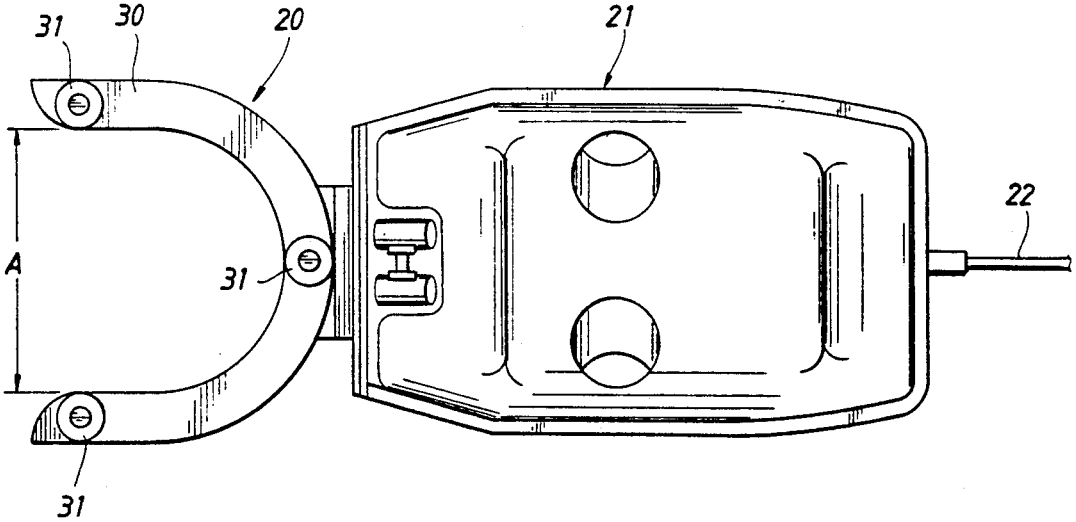
FIG. 4 is a top view of the assembly shown in FIG. 3.

Referring now to FIGS. 3 and 4, there is shown the details of the emergency release tool 20. The tool consists of a C-shaped frame member 30 that is provided with an opening having dimension A which is sufficient to encircle the members that are to be separated. As explained above, the member 30 is not a structural member and must have only sufficient rigidity for installation and to support the hydraulic jack means that are used for forcing the two members apart. Hydraulic jack means 31 are positioned on the frame member and located so that when the frame member is inserted between the flanges 12 and 13 of FIG. 1, the jacks may be equally positioned around the periphery of the members to be separated. Normally, the members will be circular members and the jack members will be positioned at equal-degree angles or spacing with respect to each other and the center of the members that are to be separated. The frame member is provided with suitable attaching means 32 which can be gripped by the arm 33 of the ROV. The details of the attachment means 32 are not shown since they depend upon the type of gripping means that is utilized by the ROV. The normal ROVs used in the oil well servicing operations have an arm 33 that is provided with three degrees of motion in addition to being capable of extending or retracting from the position shown in FIG. 3. An alternate arrangement would be to attach the release tool directly to the arm of the ROV. This requires that the release tool be retrieved by the ROV and returned to the surface after use.

The hydraulic jacks are supplied with suitable pressurized hydraulic fluid from a source not shown in the drawings. The normal ROV contains pump means for connecting hydraulic lines to the subsea equipment and for supplying hydraulic pressure for operating various subsea equipment. This source can be used for powering the jacks shown in the Figures. In addition, it is possible to incorporate a mechanically-driven hydraulic system in the emergency release tool and utilize the ROV for operating the hydraulic system. For example, a mechanically-operated pump could be driven by the tool means normally carried by the ROV for opening or closing valves or performing other mechanical operations on a subsea assembly.

The emergency release tool is operated by first either securing the tool to the ROV at the surface or providing means to transport the tool to the subsea well assembly. After the tool is secured to the ROV, the ROV can be launched and lowered into the ocean to transport the emergency release tool to the subsea well assembly. The ROV can then position the emergency release tool between the opposing flanges 12 and 13 of the two members that are to be separated as shown in FIG. 1. After the positioning of the tool is confirmed by the camera mounted on the ROV, the hydraulic jacks may be supplied with pressurized hydraulic fluid. The jacks will then expand to physically force the two opposing flanges apart and release the latches securing marine riser 11 to the wellhead assembly. The riser may then be pulled to the surface and faulty latches replaced or repaired. After separation, the hydraulic jacks may be de-energized and the release tool withdrawn from the wellhead assembly by the ROV. The ROV can then return to the surface with the release tool.

From the above description it is appreciated that the jacks operate directly on the two flanges to supply the axial force required to separate the two members. The release tool does not depend upon the use of any scissors mechanism or other mechanical levers for effecting the emergency separation of the two members. This direct acting of the jacks simplifies the construction of the release tool and greatly reduces the overall weight of the mechanism. This is an important consideration where the tool must be transported and positioned by an ROV that has a limited lift capability and also a limited capability for positioning a member.

What is claimed is:

1. An emergency release tool for forcefully removing a marine assembly from a subsea well assembly using a remotely operated vehicle, comprising:

a flat, U-shaped frame member, said frame member being adapted to be transported and positioned by said remotely operated vehicle, said frame member having at least one hydraulic means for applying an axial force substantially normal to said frame member;

means associated with said remotely operated vehicle for positioning said frame member between a flange on the marine assembly and a flange on the subsea well assembly; and means associated with said remotely operated vehicle for supplying hydraulic fluid under pressure to said at least one hydraulic means to forcefully move said flanges apart.

2. An emergency release tool operable by a remotely operated vehicle for forcefully separating two subsea members, said tool comprising:

a first flange means disposed on one of the members;

a second flange means disposed on one of the members, said second flange member being disposed adjacent and spaced from said first flange member;

a flat, U-shaped frame member, said frame member being adapted for transport and positioning between said flange members by the remotely operated vehicle;

at least one hydraulic means mounted on said frame member, said hydraulic means being disposed to produce an axial force normal to said frame member; and means for supplying hydraulic pressure to said hydraulic means to produce an axial force on said first and second flanges to forcefully separate said subsea members.

3. The apparatus of claim 2 wherein said hydraulic means comprises three hydraulic jacks mounted on said frame in positions whereby they will be equally spaced around the periphery of the flange means when said frame is positioned between said first and second flanges.

4. The apparatus of claim 2 wherein said two subsea members comprise a riser and a subsea well assembly.

5. The apparatus of claim 2 wherein said frame member includes a member fastened to said frame, said member being adapted to be gripped by an arm on said remotely operated vehicle.

6. A method for remotely separating a subsea marine structure from a subsea wellhead comprising:

lowering a jacking means from the surface to the subsea wellhead;

remotely positioning the jacking means in a position to exert a separating force on said marine structure and subsea wellhead; and actuating said jacking means to separate said marine structure and subsea wellhead.

7. The method of claim 6 wherein said jacking means is positioned between spaced, outwardly projecting flanges on said marine structure and subsea wellhead and hydraulically operated.

8. An emergency release tool for forcefully separating a marine assembly from a subsea well assembly, comprising:

a frame member disposed to be positioned between two opposed surfaces, one surface being formed on said marine assembly and the other surface being formed on said well assembly;

jack means, said jack means being mounted on said frame member to react against said one surface to force said other surface away from said one surface; and means for remotely operating said jack means to force said surfaces apart.

* * * * *